US009775426B1

(12) United States Patent
Amacker

(10) Patent No.: US 9,775,426 B1
(45) Date of Patent: Oct. 3, 2017

(54) MOBILE COMPUTER HOLDER

(71) Applicant: Google Inc., Mountain View, CA (US)

(72) Inventor: Matthew Amacker, Santa Clara, CA (US)

(73) Assignee: Google Inc., Mountain View, CA (US)

( * ) Notice: Subject to any disclaimer, the term of this patent is extended or adjusted under 35 U.S.C. 154(b) by 567 days.

(21) Appl. No.: 14/080,045

(22) Filed: Nov. 14, 2013

Related U.S. Application Data

(60) Provisional application No. 61/777,670, filed on Mar. 12, 2013.

(51) Int. Cl.
*A45C 13/30* (2006.01)
*A45F 3/02* (2006.01)
*A45F 3/14* (2006.01)

(52) U.S. Cl.
CPC ..... *A45F 3/14* (2013.01)

(58) Field of Classification Search
CPC ..... A45F 3/02
USPC ..... 224/601, 600, 605, 608, 610, 615, 625, 224/626, 666, 671, 672, 674, 675, 676, 224/257; 24/115 R; 2/570
See application file for complete search history.

(56) References Cited

U.S. PATENT DOCUMENTS 1,392,935 A * 10/1921 Glickman ..... A41F 5/00 2/326
2,588,576 A * 3/1952 Roop ..... A41D 25/003 2/145
2,746,055 A * 5/1956 Gleason ..... A41D 25/003 2/145
3,164,845 A * 1/1965 Fowler ..... A41F 5/00 2/117
5,095,546 A * 3/1992 Jones ..... A41D 25/003 2/144
5,639,004 A * 6/1997 Carlton ..... A45C 9/00 190/125
5,724,225 A * 3/1998 Hrusoff ..... A45F 3/14 206/305
5,887,777 A * 3/1999 Myles ..... A45F 3/02 190/102
5,938,096 A * 8/1999 Sauer ..... A47B 23/002 190/109
D426,955 S * 6/2000 Salvatori ..... D3/273
6,381,127 B1 * 4/2002 Maddali ..... G06F 1/163 224/257

(Continued)

OTHER PUBLICATIONS

'Solidsmack' [online]. "Design UI: Toss the Surface, Multi-touch where ever you go," 2009, [retrieved on Mar. 12, 2013]. Retrieved from the Internet: <URL: http://solidsmack.com/3d-cad-technology/design-ui-toss-the-surface-multi-touch-where-ever-you-go/> 4 pages.

(Continued)

*Primary Examiner* — Adam Waggenspack
*Assistant Examiner* — Lester L Vanterpool
(74) *Attorney, Agent, or Firm* — Fish & Richardson P.C.

(57) ABSTRACT

A mobile computer-holding device includes a pocket for holding a mobile computer. The mobile computer-holding device includes a strap that is attached to an upper portion of the pocket and that is arranged to be detachably affixed to a lower portion of the pocket, so as to affect an angle of the upper portion of the pocket with regard to a portion of the pocket within which the mobile computer is held.

18 Claims, 6 Drawing Sheets

(56) References Cited

U.S. PATENT DOCUMENTS

| | | | | |
|---|---|---|---|---|
| 6,684,413 | B2 * | 2/2004 | Cascioli | A45F 3/14 2/312 |
| 7,191,926 | B1 * | 3/2007 | Costantino | A45C 3/02 190/102 |
| 7,487,896 | B2 * | 2/2009 | Howard, Jr. | A45C 13/02 190/110 |
| 7,778,026 | B2 * | 8/2010 | Mitchell | A45C 9/00 206/522 |
| 7,780,049 | B1 * | 8/2010 | Baranoski | A45F 3/14 211/117 |
| 8,056,147 | B1 * | 11/2011 | Patel | A41D 25/003 2/145 |
| 8,844,448 | B2 * | 9/2014 | Allen | A47B 23/002 108/43 |
| 2002/0153400 | A1 * | 10/2002 | Chase | A45F 5/00 224/610 |
| 2009/0013719 | A1 | 1/2009 | Loving et al. | |
| 2010/0006614 | A1 * | 1/2010 | McLean | A45C 11/00 224/577 |
| 2010/0038393 | A1 * | 2/2010 | Zhang | A45F 5/00 224/600 |

OTHER PUBLICATIONS

'Avery' [online]. "Avery® Heavy-Duty Badge Holders for Inserts up to 3" ×4" 74471, Pack of 25," [2010] [retrieved on Mar. 12, 2013]. Retrieved from the Internet: http://www.avery.com/avery/en_us/Products/Name-Badges/Name-Badge-Accessories/Badge-Holders-__-Horizontal__74471.htm#BVRRWidgetID 2 pages.

* cited by examiner

MOBILE COMPUTER HOLDER

CROSS-REFERENCE TO RELATED APPLICATION

This application claims priority to U.S. Provisional Application Ser. No. 61/777,670, filed on Mar. 12, 2013, entitled "Mobile Computer Holder," the entire contents of which are hereby incorporated by reference.

BACKGROUND

This document generally relates to mobile computer holders.

Some computers, such as smartphones and personal digital assistants, provide functionality that was traditionally provided by computers that were not as convenient for users to carry on a regular basis. For example, some mobile computers include a multi-touch display with which users can interact with web browser user interfaces. The mobile computers may wirelessly communicate with remote computers through use of a wireless cellular network or one or more Wi-Fi routers, so as to retrieve web content for display at the request of the web browsers. The computers may provide users with access to an online marketplace through which the users are able select third-party application programs for download to the computers.

SUMMARY

Some application programs and webpages permit users of computers to participate in videoconferences. In such a videoconference, a mobile computer may display video and present audio that was recorded by a remote computing device, and may record a video and audio for transmission to and presentation by the remote computing device. The video conference may also include transmission of images that were not recorded by a camera, for example, images that were captured from screen shots of a display of a computing device. Some computers may include rear-facing video cameras, front-facing video cameras, or both front and rear-facing video cameras with which to provide video for transmission as part of the videoconferences.

This document describes mobile computer holders. Such holders may permit a user to adjust an angle of a mobile computer with respect to a user's torso, and thus an orientation of a video camera of the mobile computer. An example holder may include a lanyard that is adapted to be worn around a neck of a user, and a pocket that is adapted to at least partially hold a mobile computer. A strap may be attached to the pocket for adjusting an angle at which the computer is positioned with regard to a torso of the user.

As additional description to the embodiments described below, the present disclosure describes the following embodiments:

Embodiment 1 is a mobile computer-holding device. The device includes a pocket for holding a mobile computer. The device includes a flexible strap that (i) extends from a back side of an upper portion of the pocket, and (ii) is arranged to pass beneath the pocket and be detachably affixed to a front side of a lower portion of the pocket, so as to affect an angle of the mobile computer with respect to a torso of a user and which region in front of the user is captured in video that is recorded using a camera of the mobile computer. The flexible strap, when passing beneath the pocket and detachably affixed to the front side of the lower portion of the pocket, is arranged to hold the upper portion of the pocket bent away from the lower portion of the pocket. The device includes a lanyard that extends from the upper portion of the pocket or an upper portion of the flexible strap, for hanging the pocket around a neck of the user.

Embodiment 2 is a mobile computer-holding device. The device includes a pocket for holding a mobile computer. The device includes a flexible strap that (i) extends from a back side of an upper portion of the pocket, and (ii) is arranged to pass beneath the pocket and be detachably affixed to a front side of a lower portion of the pocket. The device includes a lanyard that extends from the upper portion of the pocket or an upper portion of the flexible strap, for hanging the pocket around a neck of a user.

Embodiment 3 is the device of embodiment 2, wherein the flexible strap is arranged to be detachably affixed to the front side of the lower portion of the pocket with a fastener device.

Embodiment 4 is the device of any one of embodiments 2 or 3, wherein the flexible strap, when passing beneath the pocket and detachably affixed to the front side of the lower portion of the pocket, is arranged to hold the upper portion of the pocket bent away from a lower portion of the pocket.

Embodiment 5 is the device of any one of embodiments 2 through 4, wherein: the flexible strap, when passing beneath the pocket and detachably affixed to the front side of the lower portion of the pocket, is arranged to set a first angle of the mobile computer with respect to the user, should the pocket be hung around the neck of the user with the mobile computer held in the pocket, and the first angle is different than a second angle of the mobile computer with respect to the user, should the pocket be hung around the neck of the user with the mobile computer held in the pocket, that results when the flexible strap is left detached from the pocket.

Embodiment 6 is the device of any one of embodiments 2 through 5, wherein the flexible strap defines an aperature that is adapted to accept (i) a button from a garment that is worn by the user, or (ii) a pinch of fabric from the garment that is worn by the user.

Embodiment 7 is the device of embodiment 2 or any one of embodiments 4 through 6, wherein the strap is arranged to be detachably affixed to the lower front portion of the pocket through vinyl-to-vinyl adhesion or vinyl-to-silicon adhesion.

Embodiment 8 is a mobile computer-holding device. The device includes a pocket for holding a mobile computer. The device includes a strap that is attached to an upper portion of the pocket and that is arranged to be detachably affixed to a lower portion of the pocket, so as to affect an angle of the upper portion of the pocket with regard to a portion of the pocket within which the mobile computer is held.

Embodiment 9 is the device of embodiment 8. The device further includes a lanyard that extends from the upper portion of the pocket or an upper portion of the strap, for hanging the pocket around a neck of a user.

Embodiment 10 is the device of embodiment 9, wherein the strap is arranged to be detachably affixed to the lower portion of the pocket, so as to affect which region in front of the user is captured in video that is recorded using a camera of the mobile computer.

Embodiment 11 is the device of any one of embodiments 8 through 10, wherein the strap is arranged to pass beneath the pocket and be detachably affixed to a front side of the lower portion of the pocket.

Embodiment 12 is the device of any one of embodiments 8 through 11, wherein: the strap comprises vinyl material; the lower front portion of the pocket comprises vinyl material; and the strap is arranged to be detachably affixed to a front side of the lower portion of the pocket through vinyl-to-vinyl adhesion or vinyl-to-silicon adhesion.

Embodiment 13 is the device of any one of embodiments 8 through 12, wherein: a front side of the pocket includes an opening through which the mobile computer is able to be inserted for being held by the pocket; and the strap is arranged to be detachably affixed to a front side of the lower portion of the pocket.

Embodiment 14 is the device of any one of embodiments 8 through 11 or 13, wherein the strap is arranged to be detachably affixed to the lower portion of the pocket with a fastener device.

Embodiment 15 is the device of embodiment 14, wherein the fastener device includes a hook-and-loop fastener device, a button fastener device, or a clasp fastener device.

Embodiment 16 is the device of any one of embodiments 8 through 15, wherein the strap is arranged to be detachably affixed to the lower portion of the pocket, so as to affect an angle of the mobile computer with regard to the user when the pocket is hung around the neck of the user.

Embodiment 17 is the device of embodiment 16, wherein the angle is formed (i) between the upper portion of the pocket and the portion of the pocket within which the mobile computer is held, and (ii) at an opening in the pocket, the opening being adapted to accept the mobile computer.

Embodiment 18 is the device of embodiment 16, wherein the strap comprises a flexible strap.

Embodiment 19 is the device of embodiment 16, wherein the front side of the pocket comprises flexible material and a back side of the pocket comprises flexible material.

Particular implementations can, in certain instances, realize one or more of the following advantages. A pocket of a computer-holding device may comprise a flexible material so as to hold mobile computers of different sizes. The flexible material may be adapted to cling to a mobile computer in order to limit movement of the mobile computer while held within the pocket, even if the pocket is sized to accommodate even larger mobile computers. A strap that is coupled to the pocket may be adapted for adjusting an angle at which the mobile computer is held in the pocket with regard to a torso of the user, and thus an angle of a camera of the mobile computer. The back of the pocket of the computer-holding device may comprise a transparent material, through which the user is able to see a touchscreen of the mobile computer. The transparent material may enable user interaction with the touchscreen through user contact with the transparent material.

The details of one or more implementations are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

This document generally describes wearable, mobile computer-holding devices. Generally, the devices include a mechanism for suspending a mobile computer from a neck of a user, and a strap for adjusting an angle at which the mobile computer is suspended from the neck of the user. One example device includes a pocket that is constructed of a vinyl material and that is adapted to hold the mobile computer at least partially with the pocket. The pocket may be suspended from a neck of the user by a lanyard, and may rest at least partially against a torso of a user. A strap may be attached to an upper portion of the pocket. The strap may be adapted to pivot the upper portion of the pocket, with respect to a remaining portion of the pocket that surrounds the mobile computer, when the strap is pulled downward. The pivoting of the upper portion of the pocket may bias at least part of the remaining portion of the pocket away from the torso of the user, causing a mobile computer that is held within the pocket to tilt downward. The user may detachably affix the strap to a lower portion of the pocket to set a desired angle of the mobile computer.

Figure 1:
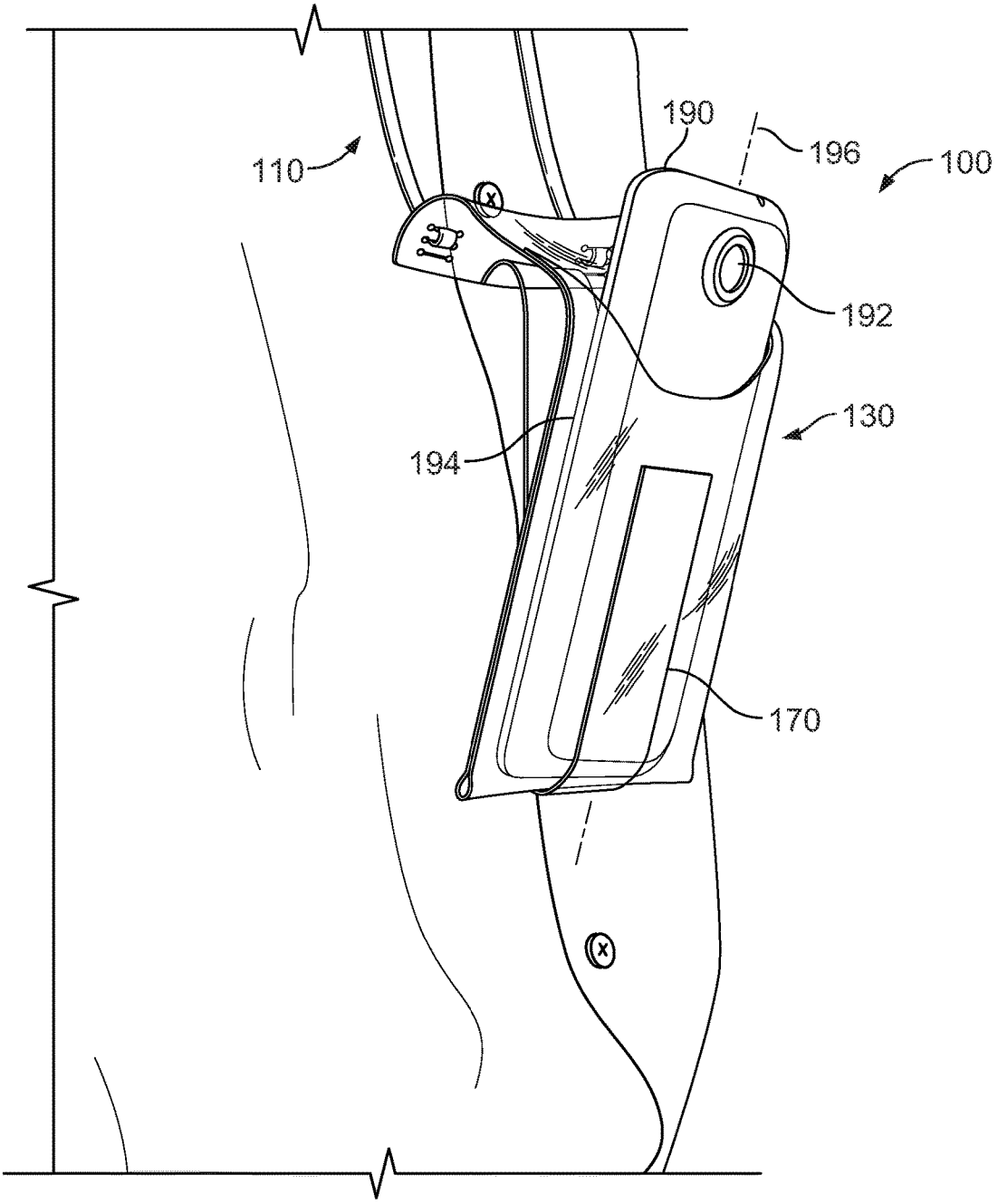
FIG. 1 shows a perspective view of an example mobile computer-holding device while the device is worn by a user.

FIG. 1 shows a perspective view of an example mobile computer-holding device 100 while the device is worn by a user. In this example, the holding device 100 includes a pocket 130 that is suspended from a neck of the user by a lanyard 110. A mobile computer 190 is held within the pocket, and a flexible strap 170 of the holding device 100 wraps under the pocket 130 and is detachably affixed to a front side of a lower portion of the pocket 130, holding an upper portion of the pocket at an angle with respect to a portion of the pocket 130 that surrounds the mobile computer 190.

The mobile computer 190, in this example, is a mobile telephone that includes a lens 192 of a rear-facing video camera. The lens 192 is located on a rear face of the mobile computer 190. The rear-facing video camera is configured to capture a sequence of images with a sensor and lens 192 that are oriented parallel with a longitudinal axis 196 of the mobile computer 190. The mobile computer 190 also includes a touchscreen display 194 on a front face of the mobile computer, where the front face opposes the rear face of the mobile computer 190.

The mobile computer 190 may be configured for video-conferencing, by including software that interacts with the rear-facing video camera to capture images, and that interacts with the touchscreen display 194 to display a user interface. The user interface may include selectable graphical user interface elements with which the user is able to modify settings of the video conference. The user interface may also present video that has been received over a network from another computer at which the video was recorded and that is remote from the mobile computer 190 (e.g., the other computer is in a different room of a venue, or is in a different city).

While participating in the video conference, a user of the mobile telephone 190 may wear the mobile computer-holding device 100 with the mobile computer 190 held therein. As a result, the user may be able to perform tasks with his or her hands in a region that is located in front of the rear-facing video camera of the mobile computer 190 so that the video may capture both hands of the user performing the tasks, and another one or more users of the video conference may be able to view video that shows the user performing the tasks. The user may be able to use the strap 170 to adjust a vertical angle of the rear-facing video camera to alter the portion of the user's environment that is being recorded by the rear-facing video camera. Without the strap 170, the tasks that are being performed by the user's hands may be performed out of a region that is captured by the video, or may not be centered in the video. The captured video may be displayed by the touchscreen 194 of the mobile telephone 190 so that the user can determine the appropriate angle.

Figure 2:
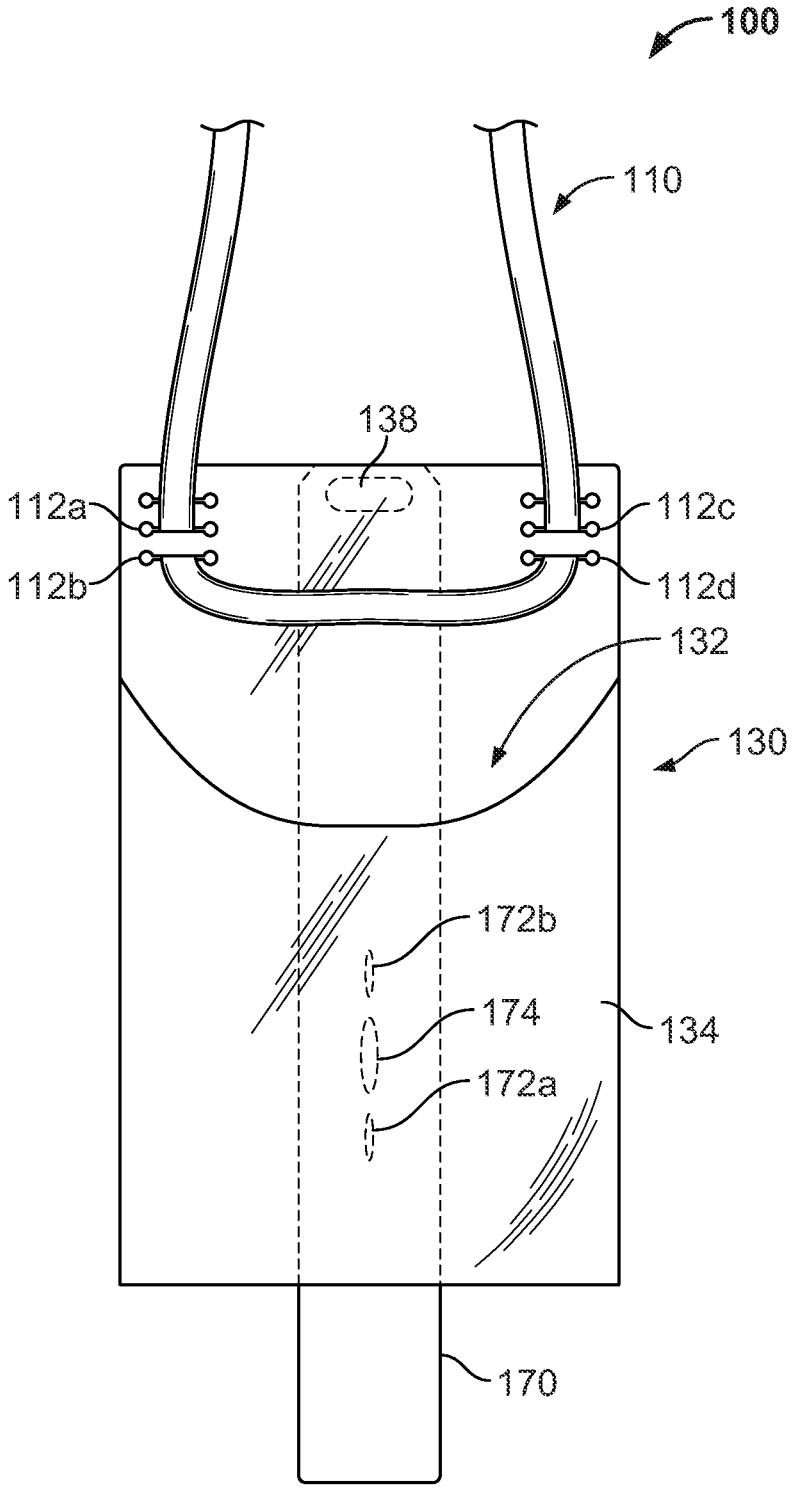
FIG. 2 shows a front view of the example mobile computer-holding device.

FIG. 2 shows a front view of the example mobile computer-holding device 100. As previously described, the holding device 100 includes a lanyard 110, a pocket 130, and a strap 170. The pocket 130 may include an opening 132 through which a user can insert the mobile computer 190 into an interior of the pocket 130 (e.g., a portion of the pocket 130 that is adapted to encircle the mobile computer 190 360 degrees). In this example, the pocket 130 comprises a single piece of vinyl material that is folded to form a bottom of the pocket 130, and that is bonded at side edges of the pocket 130 with an adhesive. The single-piece construction of the pocket 130, and the bonding of the vinyl material at the side edges of the pocket may "pinch" the mobile computer 190 that is placed within the pocket 130 so that the mobile computer is contacted by both a front side 134 of the pocket and a back side of the pocket. This construction enables the pocket 130 to hold various sizes of mobile computers. Moreover, the vinyl material may grip the mobile computer 190 to limit movement of the mobile computer 190 while the mobile computer 190 is in the pocket 130.

The pocket 130 is suspended from a neck of the user by a lanyard 110. The lanyard 110 may comprise a loop of flexible fabric such as a ribbon. The lanyard may be constructed as a unitary loop, or may have ends that a user ties together or otherwise connects with a fastener (e.g., a clasp). In some examples, the lanyard 110 comprises wire material or a collection of segmented rigid portions (e.g., a chain). In some embodiments, the device 100 may not include a lanyard 110, and may include some other mechanism for attaching the pocket 130 to the user, for example, a clip for connecting the pocket 130 to a garment that the user is wearing.

The lanyard 110 that is shown in FIG. 2 is shown as being threaded through four slits 112*a-d*, although other mechanisms for directly or indirectly connecting the lanyard 110 to the pocket 130 would be appropriate. For example, one or more portions of the lanyard 110 may couple to the pocket 130 through an adhesive, a fastener, or another coupling mechanism.

In some implementations, the lanyard 110 does not suspend the pocket 130 from a neck of the user, but rather the lanyard 110 connects the pocket 130 to another portion of the user, such as a button of a garment that covers the user's torso. In some implementations, the lanyard 110 comprises a single length of fabric that is not formed in a loop. The pocket 130 may suspend from one end of the length of fabric, and the other end of the length of fabric may include a fastener for coupling to a portion of the user, such as a garment worn by the user. In some implementations, the lanyard 110 couples to an upper portion of the strap 170 instead of the pocket 130.

The strap 170 extends from an upper portion of the pocket 130 towards the lower portion of the pocket 130. The strap 170 may extend along a back side of the pocket. The strap 170 may be constructed of a flexible fabric, such as a vinyl material. The strap 170 may be adhesively coupled to the pocket 130 at a bonding site 138. The bonding site 138 may connect the strap 170 to a back side of the pocket 130. In some examples, the strap 170 may be integrally formed with the pocket 130. In some examples, a length of the strap 170 may exceed a length of the pocket 132. The length of the strap 170 may exceed a width of the strap 170.

In some examples, the strap 170 includes one or more button holes 172*a-b* or one or more fabric holes 174. The one or more button holes 172*a-b* are adapted to receive a button, for example, a button from a collared shirt, in order to hold a portion of the strap 170 in contact with a garment to which the button is connected. Similarly, the fabric hole 174 is adapted to receive, through the fabric hole 174, a pinched portion of the garment in order to similarly hold the portion of the strap 172 in contact with the garment. The strap 170 may include one or more button holes, one or more garment holes, one or more other garment fasteners (e.g., a clip or a magnetic device), or any combination of such garment fasteners.

Figure 3:
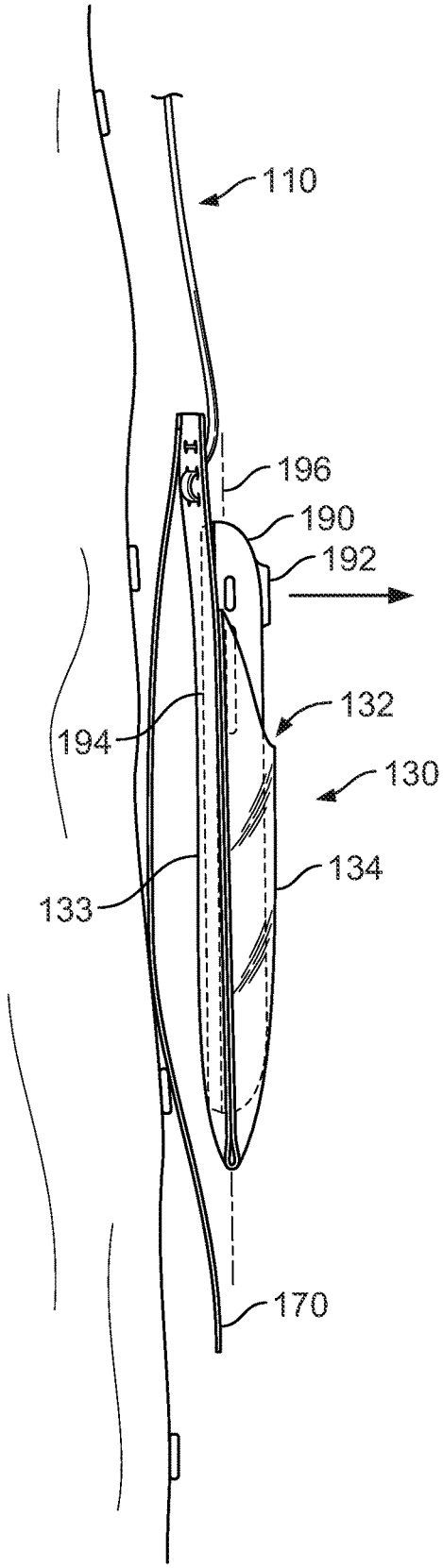
FIG. 3 shows a side view of the example mobile computer-holding device as the device is holding a mobile computer.

FIG. 3 shows a side view of the example mobile computer-holding device 100 as the device 100 is holding mobile computer 190. The mobile computer 190 is positioned within the pocket 130 with rear-facing camera 192 facing forwards (i.e., away from the user), and a touchscreen 194 facing backwards (i.e., at the user). In this example, the mobile computer-holding device 100 holds the mobile computer 190 so that the lens of the rear-facing camera 192 is oriented generally parallel with the torso of the user, and so that an upper portion of the mobile computer 190 and a lower portion of the mobile computer 190 are roughly equidistant from the torso of the user. The pocket 130 may define the opening 132 part ways down the front portion 134 of the pocket 134, such that the rear-facing camera 192 is unobstructed by any portion of the pocket 130. An upper portion of the mobile computer 190 may not be encircled by the pocket 134.

FIG. 3 illustrates the connection of the strap 170 to an upper portion of the pocket 130. As described previously, the strap 170 may be an integral portion of the pocket 130 or a separate piece of material (even though the strap 170 may comprise a same type of material as the pocket 130). An upper portion of the strap 170 may be permanently affixed to the upper portion of the pocket 130, for example, with an adhesive or mechanical fastener such as a grommet.

For clarity of presentation, the description of the figures references features of the mobile computer-holding device 100 as the device is shown being worn by a user in FIG. 3. Of course, the holding device 100 may not always be worn by a user, or worn as shown in FIG. 3, but a description of the holding device 100 from such perspective is used for to facilitate the description of the holding device 100.

For example, the front portion 134 of the pocket 130 includes the portion of the pocket 130 that faces away from the user's torso. The back portion 133 of the pocket 130 includes the portion of the pocket 130 that faces towards the user's torso. The lower portion of the pocket 130 comprises the lower half of the pocket 130 or a portion of the lower half of the pocket (e.g., a third of the pocket 130 that is farthest from the head of the user when the device is worn as shown in FIG. 3). The upper portion of the pocket 130 comprises the upper half of the pocket 130 or a portion of the upper half of the pocket (e.g., a third of the pocket 130 that is closest to the head of the user when the device is worn as shown in FIG. 3). The upper portion of the pocket 130 may comprise the portion of the pocket 130 above the opening 132 or any part of the opening 132. In some examples, the pocket 130 may be described as having a middle portion of the pocket 130 (e.g., a third of the pocket 130 that is between the upper portion of the pocket 130 and the lower portion of the pocket 130).

Figure 4:
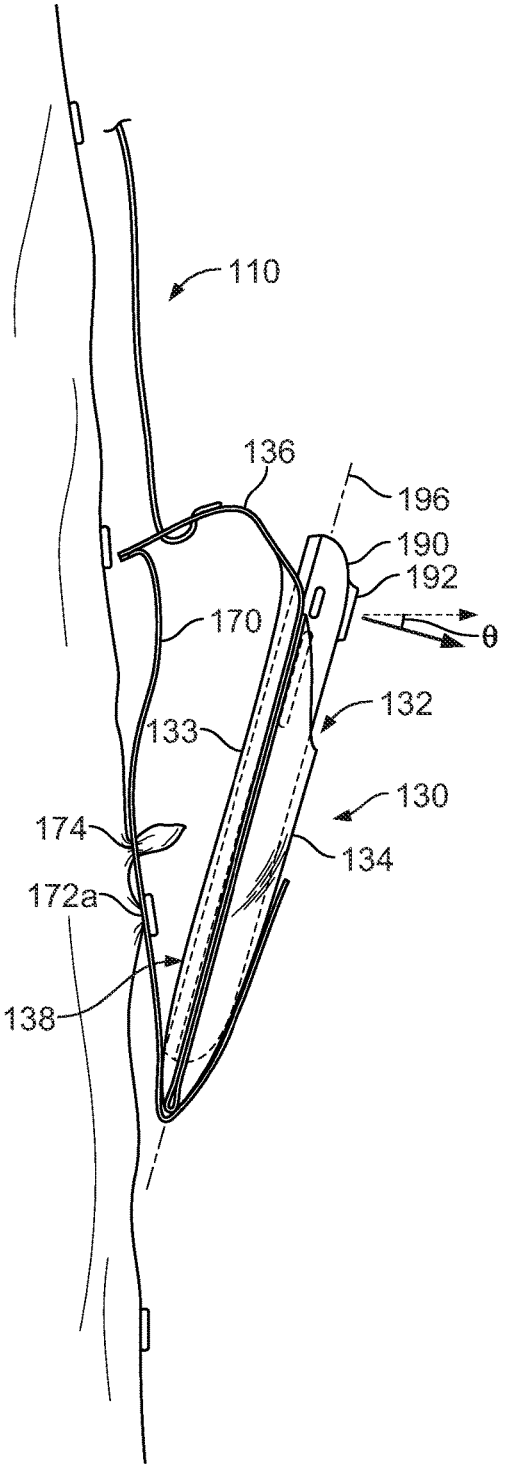
FIG. 4 shows a side view of the example mobile computer-holding device, in which a strap holds the upper portion of the pocket proximate to the torso of the user.

FIG. 4 shows a side view of the example mobile computer-holding device 100, in which the strap 170 holds the upper portion 136 of the pocket 130 proximate to the torso of the user. As a result, the weight of the mobile computer 190 may bias at least part of the pocket 130 (e.g., a portion of the pocket at the opening 132) away from the user's torso, affecting the angle of the mobile computer 190 with respect to the torso of the user and therefore affecting an angle of the lens 192 of the rear-facing camera. For example, the lens 192 of the rear-facing camera may be directed downward at an angle of θ from an orientation at which the lens 192 faces outward with respect to the user's torso.

The user may adjust the holding device 100 so the angle θ is approximately 5, 10, 15, 20, 25, 30, 35, 40, 45, 50, 55, 60, 65, or 70 degrees. A greater angle results from the user attaching the strap 170 at a higher point on the front of the pocket 130 (when the strap 170 wraps underneath the pocket), or a lower point on the back of the pocket 130. A smaller angle results from the user attaching the strap 170 at a lower point on the front of the pocket 130 (when the strap 170 wraps underneath the pocket), or a higher point on the back of the pocket 130.

The folding of the upper portion 136 of the pocket 100 backwards, due to tension applied by the strap 170, may result in the upper portion 136 of the pocket 130 and the bottom portion of the pocket 130 being in contact with a garment covering the user's torso, and the opening 132 being at least 1, 2, 3, or 4 cm away from the garment cover the user's torso. The pocket may be 17.2 cm long and 10.1 cm wide, and have a strap that is 21.3 cm long.

In effect, the tension applied by the strap 170 to the upper portion 136 of the pocket causes the upper portion 136 of the pocket 130 to wedge itself between the user's torso and the remaining portion of the pocket 130 that holds the mobile device 190. A similar wedge may not result at a bottom of the pocket 130, causing the lower portion of the pocket 130 and the mobile device 190 to orient in a non-parallel relation with regard to the torso of the user.

In the example shown in FIG. 4, the strap 170 passes underneath the pocket 130 and detachably affixes to a front portion of the pocket 130. The strap 170 may detachably affix to the front portion of the pocket 130 through adhesion resulting from vinyl on vinyl adhesion without a separate fastening device. In some examples, the strap 170 detachably affixes to the pocket 130 through adhesion resulting from silicon on vinyl adhesion (e.g., one of the strap 170 and the pocket 130 may comprise a silicon material). In some examples, the strap 170 and the pocket 130 are formed of one or more other materials that temporarily adhere to each other when placed in contact with each other. In some examples, the strap 170 detachably affixes to the front side of the lower portion of the pocket 130 through a fastening device, such as a hook and loop fastener, a button, or a clasp. The strap 170 and optional fastening device may be adapted to permit repeated attachments of the strap 170 to the pocket 130 without reducing an ability of the strap 170 to affix to the pocket 130. In some examples, the strap 170 and the pocket 130 may include multiple buttons or clasps to permit attachment at various positions.

In some implementations, the strap 170 detachably affixes to the back portion of the pocket 130 without passing underneath the pocket 130. The strap 170 may detachably affix using the above-described fastening device (e.g., a hook and loop fastener, a button, or a clasp). The fastening device may be located on a back side of the pocket 130, for example, at a lower portion of the pocket 130 such as at location 138.

The strap 170 includes button hole 172*a* and fabric hole 174, through which a button and a portion of fabric have been manipulated by a user so as to detachably affix the strap 170 to the garment that covers the user's torso. As a result, should the user bend forward, the computer-holding device 100 may not sway away from the user's torso more than a distance permitted by any looseness in the user's garment. Affixing the strap 170 to the garment may keep the mobile device 190 close to the user's torso, and thus may prevent damage to the computer 190 or objects that the computer 190 or the pocket 130 may contact. Moreover, attaching the strap 170 to the user's garment permits the user to further control the angle of the rear-facing camera 192 through movement of the user's torso. In some examples, the button hole 172*a* or the fabric hole 174 are located on the back side of the pocket 130.

Figure 5:
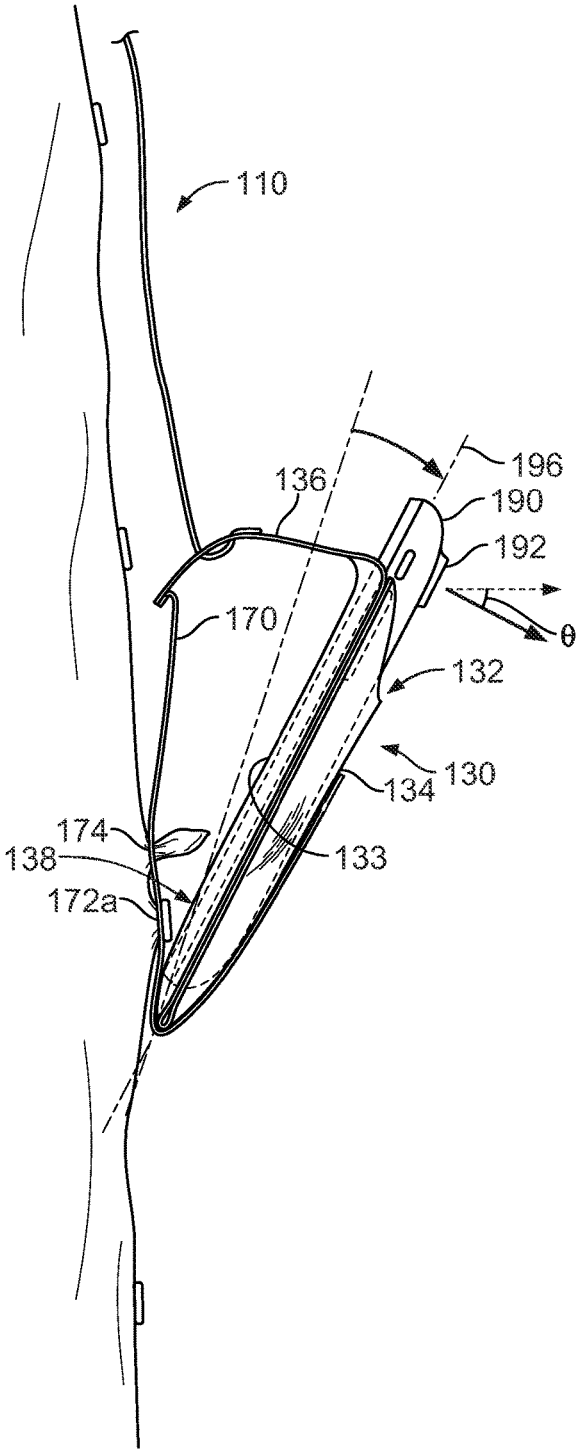
FIG. 5 shows a side view of the example mobile computer-holding device, in which the strap is adjusted to hold the mobile computer at a greater downward angle than the strap adjustment that is shown in FIG. 4.

FIG. 5 shows a side view of the example mobile computer-holding device 100, in which the strap 170 is adjusted to hold the mobile computer 190 at a greater downward angle than the strap adjustment that is shown in FIG. 4. In this example, the user has pulled the strap 170 downwards farther than shown in FIG. 4, and has attached the strap 170 higher up the front side of the pocket 130. The greater tension that is applied to the strap 170 results in the upper portion 136 of the pocket being pulled at a greater angle backwards, and thus the mobile computer 190 tilting downwards at a greater angle. The strap 170 may slide along a the user's torso during adjustment of the strap 170. For this reason, the strap 170 may include multiple button holes 172*a-b*, multiple fabric holes 174, or a combination of both, to permit the user to attach the strap 170 to the user's garment regardless of the position of the strap 170.

Figure 6:
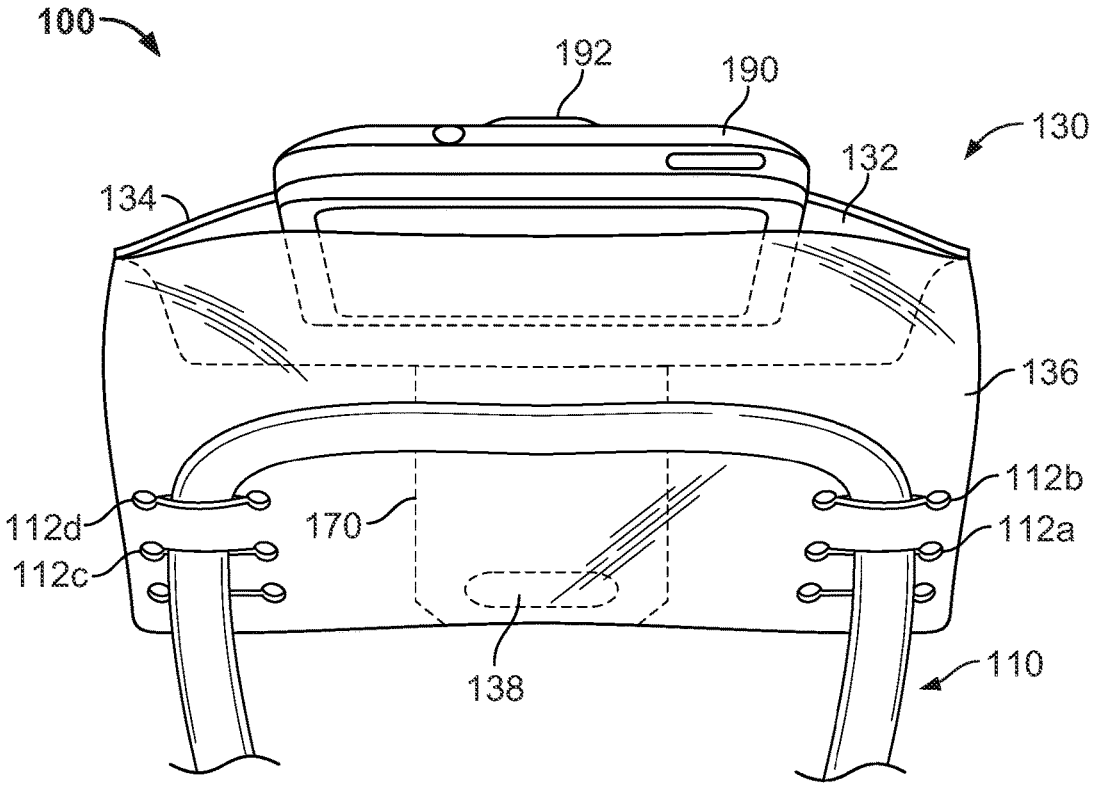
FIG. 6 shows a top view of the example mobile computer-holding device.

FIG. 6 shows a top view of the example mobile computer-holding device 100. The top view shows how the strap 170 may attach to the pocket 130 closer to the user's torso than the slits 112*a-d* through which the lanyard 110 passes. In some examples, the lanyard 100 connects to the pocket 130 at a location that is closer to the opening 132 than the top-most portion of the pocket 130 (when in the orientation shown in FIG. 3). The portion of the mobile computer 190 that has been inserted through the opening 132 may be encircled completely by the pocket 130, while a remaining portion of the pocket 130 (e.g., the upper portion 136 of the pocket) may not completely encircle the mobile computer 190.

The pocket 130 may comprise a flexible material to hold computers of various sizes, with or without protective cases. The pocket 130 may comprise a single piece of material folded at a bottom portion of the pocket 130 and adhesively coupled along edges of the pocket 130, or may comprise separate pieces of material adhesively coupled at the edges and at the bottom. The pocket 130 may comprise a material that is transparent, and that is adapted to permit a user to manipulate a touch screen device (e.g., a capacitive touch-screen device) with the user's finger when the material is placed between the touchscreen and the user's finger. In some implementations, the pocket 130 may comprise a rigid material and may be pre-formed to fit a mobile device of a particular model or size.

In some implementations, the pocket 130 may comprise multiple straps 130. The multiple straps 130 may connect to the pocket 130 near corners of the upper portion 136 of the pocket instead of in a center of the upper portion of the pocket, and may run parallel to the locations at which the straps detachably affix to the pocket 130.

In some implementations, the pocket 130 defines a hole at a bottom of the pocket through which a cable for charging the mobile computer 190 or a cable for headphones may pass to connect with a corresponding port that is located at a bottom of the mobile computer 190.

In some implementations, the mobile computer 190 is a personal digital assistant or a camera. The camera may not include a touchscreen display or an ability to display web pages.

Figure 7:
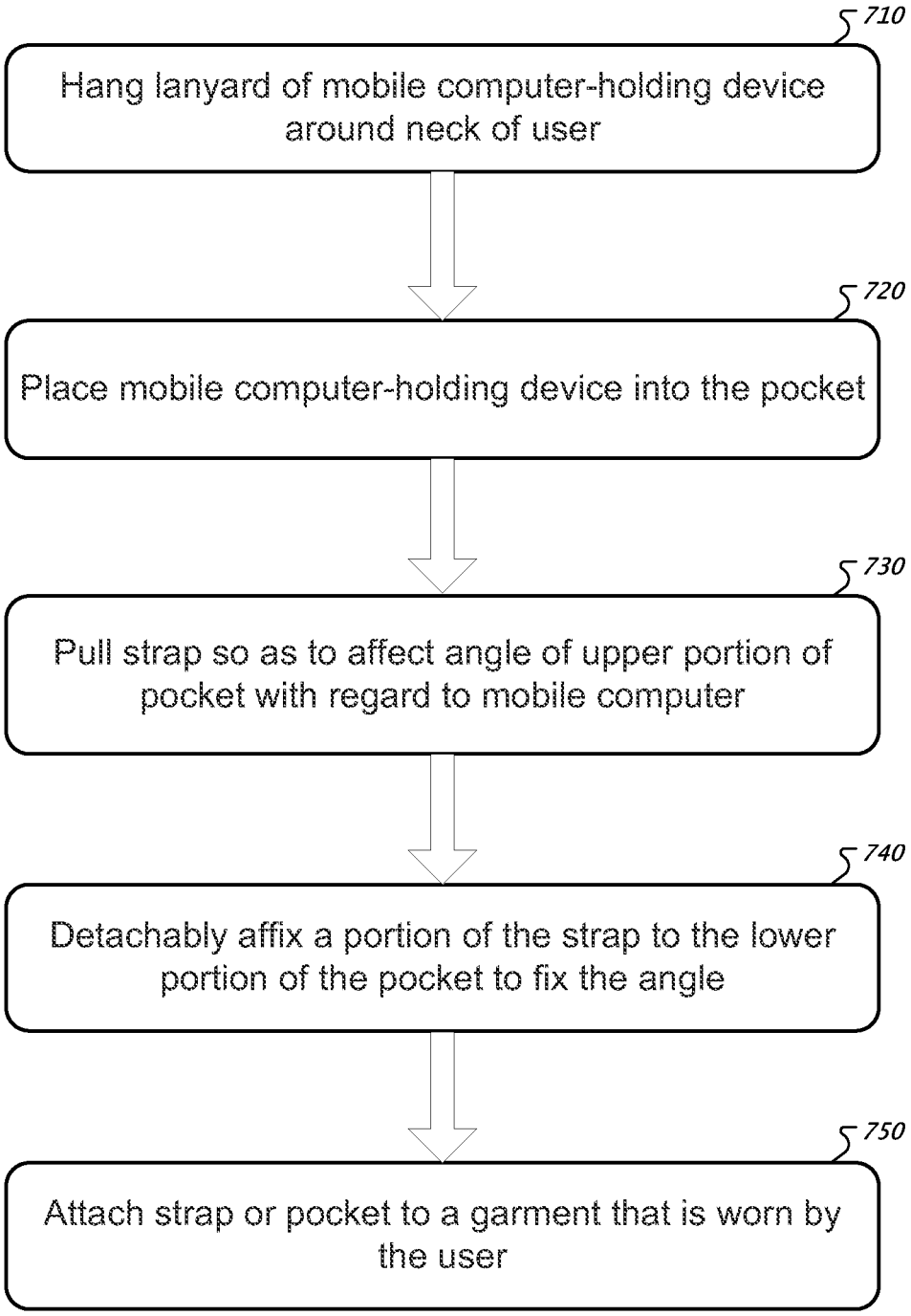
FIG. 7 shows a flowchart that illustrates a method for orienting the wearable, mobile computer-holding device.

FIG. 7 shows a flowchart that illustrates a method for orienting the mobile computer-holding device 100.

At box 710, a user hangs a lanyard 110 of the mobile computer-holding device 100 around a neck of the user. For example, the user can grasp the lanyard 110 and place it over the user's head so that the pocket 130 hangs in front of a torso of the user.

At box 720, the user places a mobile computer-holding 190 device into the pocket 130. For example, the user places the computer 190 into the pocket 130 by directing a bottom of the computer 190 through the opening 132. The operations of box 520 may occur after the user hangs the lanyard 110 around the user's neck (box 510) or before the user hangs the lanyard 110 around the user's neck (box 510).

At box 730, the user pulls the strap 170 so as to affect an angle of the upper portion of the pocket 130 with respect to the mobile computer 190 that is held within the pocket 130. For example, while the pocket 130 is hanging by lanyard 110 from the user's neck, the user may pull strap 170 downward and away from the user's neck to cause the upper portion 136 of the pocket 130 (which had previously been aligned with a longitudinal axis 196 of the computer 190) to bend at an angle with respect to the longitudinal axis 196 of the computer (e.g., an axis that is parallel to a face of the touchscreen 196).

At box 740, the user detachably affixes a portion of the strap 170 to the lower portion of the pocket 130 while the user is holding the strap 170 downwards, so as to fix the angle of the upper portion 136 of the pocket with respect to the mobile computer 190 that is held within the pocket. For example, the user may press a lower portion of the strap 170 to the front side of the pocket 130. The user may also attach a portion of a fastener on the strap 170 with a corresponding portion of the fastener on a front or back side of the pocket 130. Although the upper portion 136 of the pocket may flex, the angle of the upper portion of the pocket 130 may be an average angle of each portion of the upper portion of the pocket 130 (e.g., an integrated calculation of the angle).

At box 750, the user attaches the strap or the pocket to a garment that is worn by the user. For example, the user may place a button through one of button holes 172*a-b* or may pull a portion of the garment through fabric hole 174. The button holes 172*a-b* or the fabric hole 174 may be located in the pocket 130 instead of in the strap 170. Alternatively or in addition, the strap 170 or the pocket 130 may include a fastener (e.g., a clip) for coupling the strap 170 or the pocket 130 to the garment.

In general, one aspect of the subject matter described in this disclosure can be embodied in a method for orienting a mobile computer-holding device. The method includes hanging a lanyard of the mobile computer-holding device around a neck of a user. The device includes a pocket for holding a mobile computer, and a strap that is attached to an upper portion of the pocket and that is arranged to be detachably affixed to a lower portion of the pocket, the lanyard extending from the upper portion of the pocket or an upper portion of the strap. The method includes placing the mobile computer into the pocket. The method includes pulling the strap so as to affect an angle of the upper portion of the pocket with respect to the mobile computer that is held within the pocket. The method includes detachably affixing a portion of the strap to the lower portion of the pocket while the strap is pulled so as to fix the angle of the upper portion of the pocket with respect to the mobile computer that is held within the pocket. The method may optionally include attaching the strap or the pocket to a garment that is worn by the user.

Although a few implementations have been described in detail above, other modifications are possible. Moreover, other mechanisms for performing the systems and methods described in this document may be used. In addition, the logic flows depicted in the figures do not require the particular order shown, or sequential order, to achieve desirable results. Other steps may be provided, or steps may be eliminated, from the described flows, and other components may be added to, or removed from, the described systems. Accordingly, other implementations are within the scope of the following claims.

What is claimed is:

1. A mobile computer-holding device, comprising:

a pocket for holding a mobile computer;

a flexible strap that (i) extends from a back side of an upper portion of the pocket, and (ii) is arranged to pass beneath the pocket and be detachably affixed to a front side of a lower portion of the pocket, so as to affect an angle of the mobile computer with respect to a torso of a user and which region in front of the user is captured in video that is recorded using a camera of the mobile computer, wherein adjusting a location at which the flexible strap is affixed to the front side of the lower portion of the pocket adjusts the angle of the mobile computer, wherein the flexible strap, when passing beneath the pocket and detachably affixed to the front side of the lower portion of the pocket, is arranged to hold the upper portion of the pocket bent away from the lower portion of the pocket;

wherein the flexible strap defines an aperture that is adapted to accept (i) a button from a garment that is worn by the user, or (ii) a pinch of fabric from the garment that is worn by the user; and a lanyard that extends from the upper portion of the pocket or an upper portion of the flexible strap, for hanging the pocket around a neck of the user.

2. A mobile computer-holding device, comprising:

a pocket for holding a mobile computer;

a flexible strap that (i) extends from a back side of an upper portion of the pocket, and (ii) is arranged to pass beneath the pocket and be detachably affixed to a front side of a lower portion of the pocket, wherein adjusting a location at which the flexible strap is affixed to the front side of the lower portion of the pocket adjusts the angle of the mobile computer, wherein the flexible strap defines an aperture that is adapted to accept (i) a button from a garment that is worn by a user, or (ii) a pinch of fabric from the garment that is worn by the user; and a lanyard that extends from the upper portion of the pocket or an upper portion of the flexible strap, for hanging the pocket around a neck of the user.

3. The mobile computer-holding device of claim 2, wherein the flexible strap is arranged to be detachably affixed to the front side of the lower portion of the pocket with a fastener device.

4. The mobile computer-holding device of claim 2, wherein the flexible strap, when passing beneath the pocket and detachably affixed to the front side of the lower portion of the pocket, is arranged to hold the upper portion of the pocket bent away from a lower portion of the pocket.

5. The mobile computer-holding device of claim 4, wherein:

the flexible strap, when passing beneath the pocket and detachably affixed to the front side of the lower portion of the pocket, is arranged to set a first angle of the mobile computer with respect to the user, should the pocket be hung around the neck of the user with the mobile computer held in the pocket, and the first angle is different than a second angle of the mobile computer with respect to the user, should the pocket be hung around the neck of the user with the mobile computer held in the pocket, that results when the flexible strap is left detached from the pocket.

6. The mobile computer-holding device of claim 2, wherein the strap is arranged to be detachably affixed to the lower front portion of the pocket through vinyl-to-vinyl adhesion or vinyl-to-silicon adhesion.

7. A mobile computer-holding device, comprising:

a pocket for holding a mobile computer; and a strap that is attached to an upper portion of the pocket and that is arranged to be detachably affixed to a lower portion of the pocket, so as to affect an angle of the upper portion of the pocket with regard to a portion of the pocket within which the mobile computer is held, wherein adjusting a location at which the strap is affixed to the lower portion of the pocket adjusts the angle of the mobile computer, wherein the strap defines an aperture that is adapted to accept (i) a button from a garment that is worn by a user, or (ii) a pinch of fabric from the garment that is worn by the user.

8. The mobile computer-holding device of claim 7, further comprising a lanyard that extends from the upper portion of the pocket or an upper portion of the strap, for hanging the pocket around a neck of the user.

9. The mobile computer-holding device of claim 8, wherein the strap is arranged to be detachably affixed to the lower portion of the pocket, so as to affect which region in front of the user is captured in video that is recorded using a camera of the mobile computer.

10. The mobile computer-holding device of claim 7, wherein the strap is arranged to pass beneath the pocket and be detachably affixed to a front side of the lower portion of the pocket.

11. The mobile computer-holding device of claim 10, wherein:

the strap comprises vinyl material;

the lower front portion of the pocket comprises vinyl material; and the strap is arranged to be detachably affixed to a front side of the lower portion of the pocket through vinyl-to-vinyl adhesion or vinyl-to-silicon adhesion.

12. The mobile computer-holding device of claim 7, wherein:

a front side of the pocket includes an opening through which the mobile computer is able to be inserted for being held by the pocket; and the strap is arranged to be detachably affixed to a front side of the lower portion of the pocket.

13. The mobile computer-holding device of claim 7, wherein the strap is arranged to be detachably affixed to the lower portion of the pocket with a fastener device.

14. The mobile computer-holding device of claim 13, wherein the fastener device includes a hook-and-loop fastener device, a button fastener device, or a clasp fastener device.

15. The mobile computer-holding device of claim 7, wherein the strap is arranged to be detachably affixed to the lower portion of the pocket, so as to affect an angle of the mobile computer with regard to the user when the pocket is hung around the neck of the user.

16. The mobile computer-holding device of claim 15, wherein the angle is formed (i) between the upper portion of the pocket and the portion of the pocket within which the mobile computer is held, and (ii) at an opening in the pocket, the opening being adapted to accept the mobile computer.

17. The mobile computer-holding device of claim 15, wherein the strap comprises a flexible strap.

18. The mobile computer-holding device of claim 15, wherein the front side of the pocket comprises flexible material and a back side of the pocket comprises flexible material.

* * * * *